US007753135B2

(12) United States Patent
Lennartz

(10) Patent No.: US 7,753,135 B2
(45) Date of Patent: Jul. 13, 2010

(54) POWER TOOL WITH A ROTATING AND/OR HAMMERING DRIVE MECHANISM

(75) Inventor: Juergen Lennartz, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 566 days.

(21) Appl. No.: 11/108,954

(22) Filed: Apr. 19, 2005

(65) Prior Publication Data

US 2005/0236168 A1 Oct. 27, 2005

(30) Foreign Application Priority Data

Apr. 24, 2004 (DE) ..... 10 2004 020 177

(51) Int. Cl.
*B25D 11/04* (2006.01)

(52) U.S. Cl. ..... 173/109; 173/48; 173/201; 173/216

(58) Field of Classification Search ..... 173/109, 173/104, 201, 213, 216, 217, 48, 114
See application file for complete search history.

(56) References Cited

U.S. PATENT DOCUMENTS 3,680,642 A * 8/1972 Kirn et al. ..... 173/13
3,785,443 A * 1/1974 Armbruster ..... 173/48
3,799,275 A * 3/1974 Plattenhardt et al. ..... 173/48
4,223,744 A * 9/1980 Lovingood ..... 173/48
4,284,148 A * 8/1981 Wanner et al. ..... 173/109
4,325,436 A * 4/1982 Richter et al. ..... 173/13
4,456,076 A * 6/1984 Schmid et al. ..... 173/201
4,732,217 A * 3/1988 Bleicher et al. ..... 173/104
4,805,706 A 2/1989 Stone
5,036,925 A * 8/1991 Wache ..... 173/48
5,337,835 A * 8/1994 Bohne et al. ..... 173/13
5,373,905 A * 12/1994 Bleicher et al. ..... 173/109
5,415,240 A * 5/1995 Mundjar ..... 173/48
5,447,205 A * 9/1995 Thurler ..... 173/48
5,588,496 A * 12/1996 Elger ..... 173/178
5,787,996 A * 8/1998 Funfer ..... 173/104
6,112,830 A * 9/2000 Ziegler et al. ..... 173/109
6,142,242 A 11/2000 Okumura et al.
6,223,833 B1 * 5/2001 Thurler et al. ..... 173/48
6,550,546 B2 * 4/2003 Thurler et al. ..... 173/48
6,918,450 B2 * 7/2005 Lebisch et al. ..... 173/104
7,019,479 B2 3/2006 Tobias et al.

FOREIGN PATENT DOCUMENTS

DE 2 209 575 1/1973
EP 1 555 091 A2 7/2005
WO 89/11955 12/1989
WO 97/21524 6/1997
WO 03/099632 12/2003

* cited by examiner

*Primary Examiner*—Scott A. Smith
(74) *Attorney, Agent, or Firm*—Michael J. Striker

(57) ABSTRACT

A handheld power tool with a rotating and/or hammering drive mechanism for a tool (11) that can be inserted into a tool receptacle (10) has a unit which transmit the rotation of a motor shaft (5) to an intermediate shaft (7), by which the tool receptacle (10) is set into a rotary motion and/or a hammering motion. A compact construction of the handheld power tool is attained by providing that the motor shaft (5) is coupleable or is coupled to the intermediate shaft (7) in one axis.

8 Claims, 3 Drawing Sheets

POWER TOOL WITH A ROTATING AND/OR HAMMERING DRIVE MECHANISM

BACKGROUND OF THE INVENTION

The present invention relates to a handheld power tool with a rotating and/or hammering drive mechanism for a tool that can be inserted into a tool receptacle, in which there are means which transmit the rotation of the shaft of a motor to an intermediate shaft, and in which a device is provided which converts the rotary motion of the intermediate shaft into a rotary motion of the tool receptacle, and/or the intermediate shaft is provided with a motion converter, which converts a rotary motion of the intermediate shaft into a hammering motion of the tool receptacle.

Typically, drill hammers/chisel hammers are constructed in this way, as taught for instance by European Patent Disclosure EP 444030 B1. In these known drill hammers/chisel hammers, the motor, with its motor shaft and via a spur gear, drives an intermediate shaft that is rotatably supported in the power tool housing. A further spur gear converts the rotary motion of the intermediate shaft into a rotation of the tool receptacle, with the tool inserted in it. A swash bearing located on the intermediate shaft sets a hammering mechanism, which integrated with the tool receptacle, into an axial reciprocating motion. Because of the mode of construction described above, and in particular because of the gear required between the motor shaft and the intermediate shaft that is offset from it, the tools have a relatively long structural length, which makes them relatively inconvenient to handle and makes it more difficult to start drilling exactly. Especially in drill hammers/chisel hammers with a battery pack, this disadvantage becomes serious.

SUMMARY OF THE INVENTION

It is therefore the object of the invention to disclose a handheld power tool of the type defined at the outset that has the most compact possible construction and furthermore is high-powered.

This object is attained with the characteristics of claim 1, in that the motor shaft is coupleable or is coupled to the intermediate shaft in one axis.

This axial coupling between the motor shaft and the intermediate shaft can be accomplished with a motor which exerts a torque required for driving the intermediate shaft. Because of the avoidance of a radial offset between the motor shaft and the intermediate shaft, the structural length of the handheld power tool can be shortened, since there is no need to take the stroke of the hammering mechanism into consideration.

Advantageous refinements of the invention are disclosed by the dependent claims.

Between the motor shaft and the intermediate shaft, a coupling and/or a planetary gear may be inserted. The coupling makes decoupling possible between the motor shaft and the intermediate shaft, a planetary gear makes a selectable stepup of the coupling between the motor shaft and the intermediate shaft possible.

It is expedient to use a motor which is an electronically commutated direct-current motor constructed as an internal or external rotor motor. External rotor motors (for instance as known from German Patent Disclosure DE-OS 2209575), despite being relatively small in structural size, furnish high torque, which makes it possible to drive the intermediate shaft of the handheld power tool directly—without a gear stage—via the motor shaft.

Further dependent claims define advantageous exemplary embodiments for supporting the motor shaft of an external rotor motor.

For instance, the motor shaft or the intermediate shaft may be rotatably supported on the end toward the motor in a flange fixed to the power tool housing. Moreover, the motor shaft, connected to the rotor of the external rotor motor, protrudes with its end facing away from the intermediate shaft into the stator of the external rotor motor and may be rotatably supported therein at at least one point. Also, the motor shaft connected to the rotor of the external rotor motor, extends through the stator to the intermediate shaft, and the stator, on its side facing toward the intermediate shaft, has a bearing bridge which is fixed to the power tool housing and in which the motor shaft may be rotatably supported. In addition, the motor shaft may be additionally rotatably supported, on its end facing away from the intermediate shaft, in the stator.

For coupling the motor shaft to the intermediate shaft, it is advantageous to employ a coupling between the motor shaft and the intermediate shaft. A very simple embodiment is that the motor shaft forms a unit with the intermediate shaft.

The invention is described in further detail below in terms of several exemplary embodiments shown in the drawings.

DETAILED DESCRIPTION OF THE PREFERRED EMBODIMENTS

Figure 1:
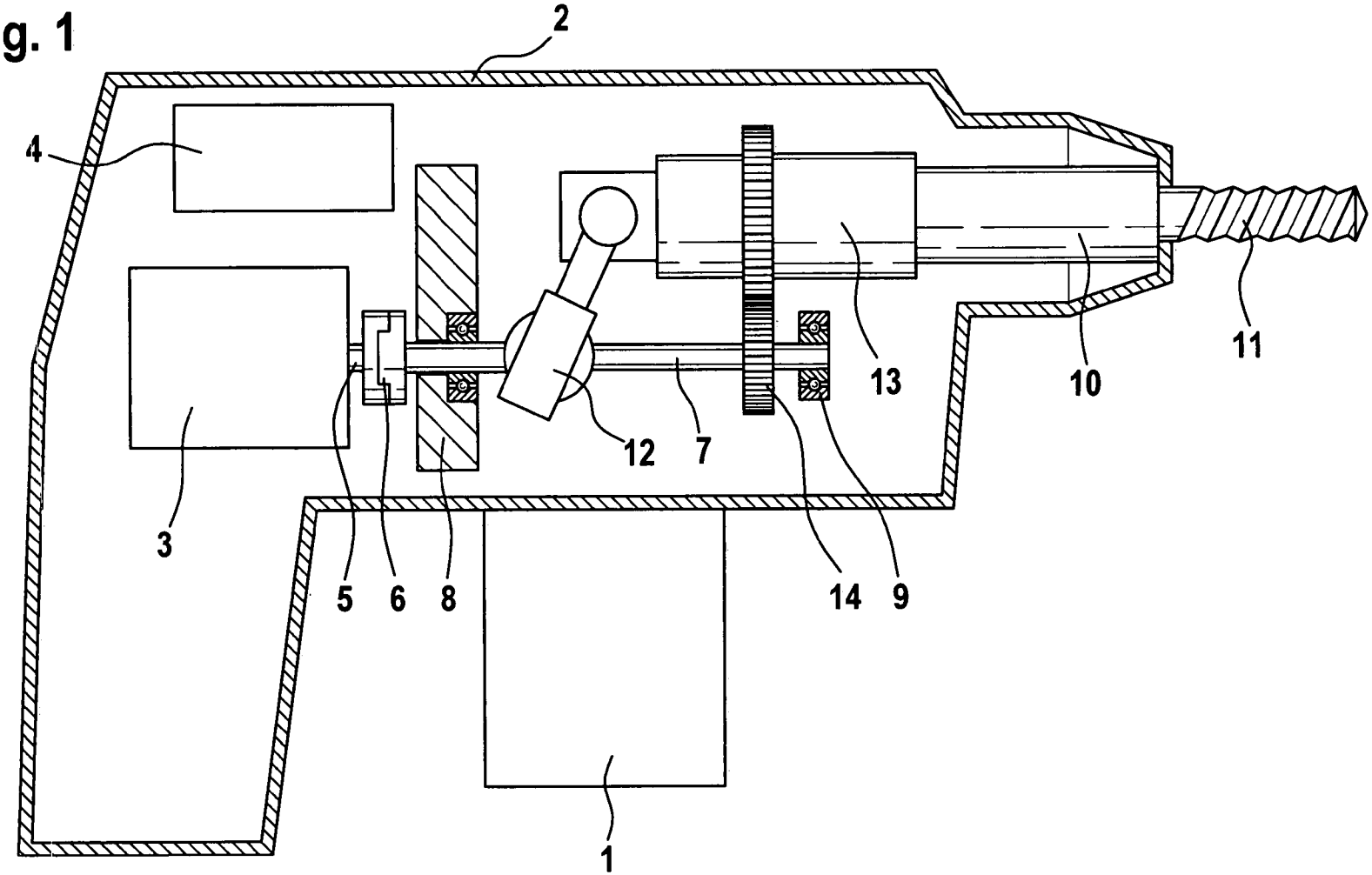
FIG. 1 is a basic illustration of a drill hammer/chisel hammer, in which a motor is coupled to an intermediate shaft via a coupling and/or a planetary gear.

FIG. 1 shows the functional units of a drill hammer/chisel hammer. The exemplary embodiment shown is a drill hammer/chisel hammer which draws its energy from a battery 1, for instance. The battery 1 is coupleable to the power tool housing 2 at a suitable point.

In the interior of the power tool housing 2, there is a motor 3, preferably an electronically commutated direct-current motor. For this motor 3, there is a control circuit 4, with which the rpm or torque of the motor 3 is controllable. The motor shaft 5 is coupleable directly to an intermediate shaft 7 via a coupling and/or a planetary gear 6. In the coupled state, the torque of the motor shaft 5 is accordingly transmitted directly to the intermediate shaft 7 via a planetary gear. The coupling makes decoupling possible between the motor shaft and the intermediate shaft, and a planetary gear makes a selectable stepup of the coupling between the motor shaft and the intermediate shaft possible. On the end toward the motor, the intermediate shaft 7 is rotatably supported in a flange 8, which is fixed to the power tool housing 2. A second rotary bearing 9 fixed to the power tool housing 2 is located on the other end of the intermediate shaft 7.

An axial hammering motion on the one hand and a rotary motion on the other are transmitted by the intermediate shaft 7 to a tool receptacle 10, in which a tool 11 (such as a drill or chisel) can be inserted. A motion converter, such as a known swash bearing 12, located on the intermediate shaft 7 converts the rotary motion of the intermediate shaft 7 into a reciprocating axial motion of a hammer in a hammering mechanism 13 coupled to the tool receptacle 10. A detailed description of the swash bearing 12 and of the hammering mechanism 13 is not provided here, because these are well-known devices (known for instance from EP 444030 B1), which are moreover not the subject of the present invention.

The rotary motion of the intermediate shaft 7 is converted into a rotary motion of the tool receptacle 10 by means of a gear 14, such as a spur gear.

Figure 2:
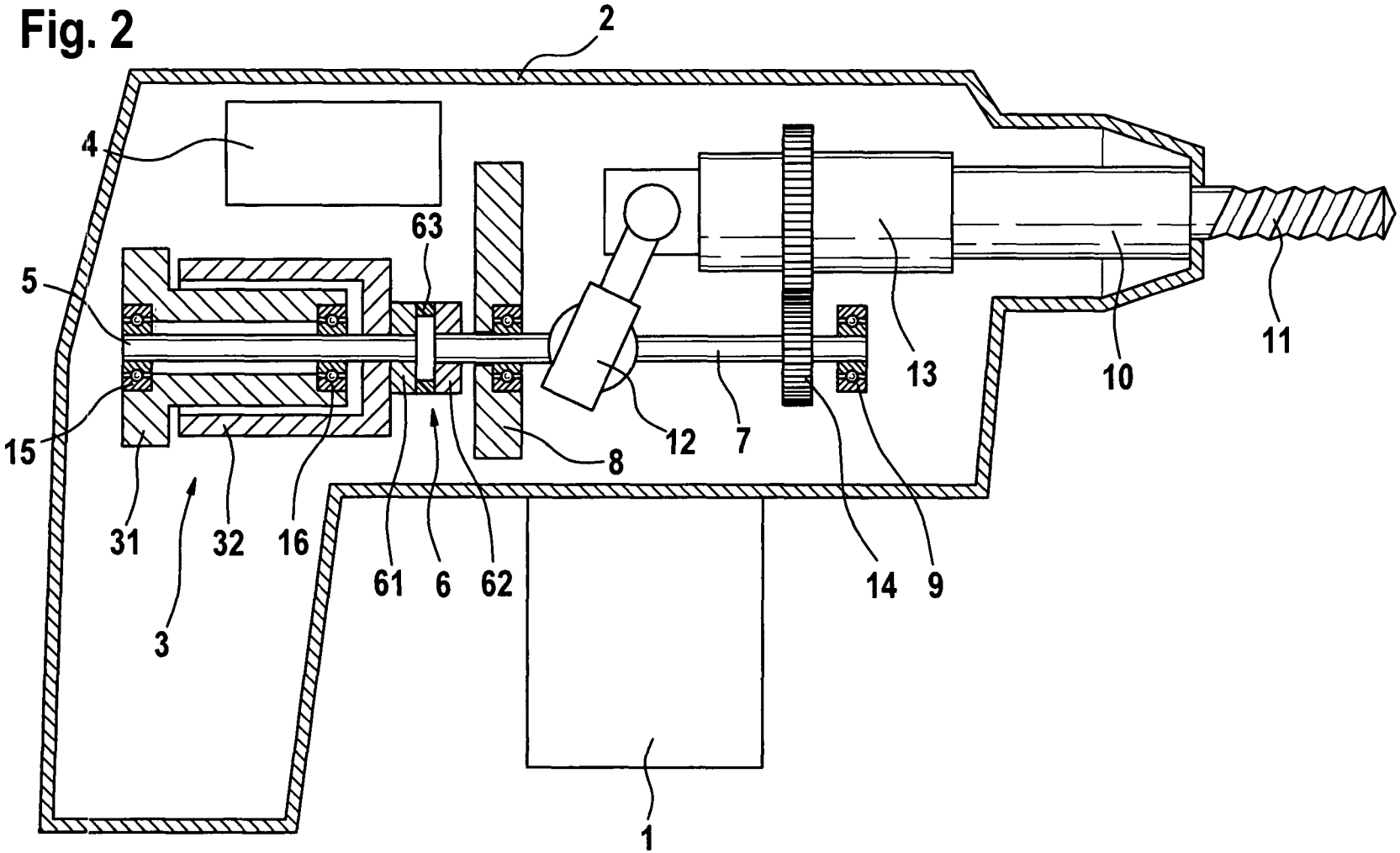
FIG. 2 is a basic illustration of a drill hammer/chisel hammer, in which the intermediate shaft is coupled to an external rotor motor via a coupling.

FIG. 2 shows the same exemplary embodiment of a drill hammer/chisel hammer as in FIG. 1, but with a special electronically commutated direct-current motor 3, which is constructed as an external rotor motor. External rotor motors are known per se (for instance from DE-OS 2209575). The external rotor motor comprises a stator 31 and a cup-shaped rotor 32 surrounding it. The stator 31 is fixed to the power tool housing 2. The motor shaft 5 is fixedly connected to the rotor 32. As already described in conjunction with the exemplary embodiment of FIG. 1, the motor shaft 5 can be connected to the intermediate shaft 7 via a coupling 6. As shown in FIG. 2, the coupling 6 in a known way comprises two coupling disks 61 and 62; the coupling disk 61 toward the motor is connected fixedly to the motor shaft 5, and the coupling disk 62 is connected fixedly to the intermediate shaft 7. An elastic intermediate element 63 may also be located between the two coupling disks 61 and 62.

In the exemplary embodiment shown in FIG. 2, the external rotor motor is constructed such that its cup-shaped rotor 32 is oriented with its cup bottom, on which the motor shaft 5 is fixed, toward the intermediate shaft. In this way, the motor shaft 5 can be radially supported very exactly, because the motor shaft 5 protrudes into the stator 31 and is rotatably supported therein by means of two rotary bearings 15 and 16. A first rotary bearing 15 is located on the end of the stator 31 affixed to the power tool housing 2, and the other rotary bearing 16 is located in the stator 31, in the vicinity of the cup bottom of the cup-shaped rotor 32.

Figure 3:
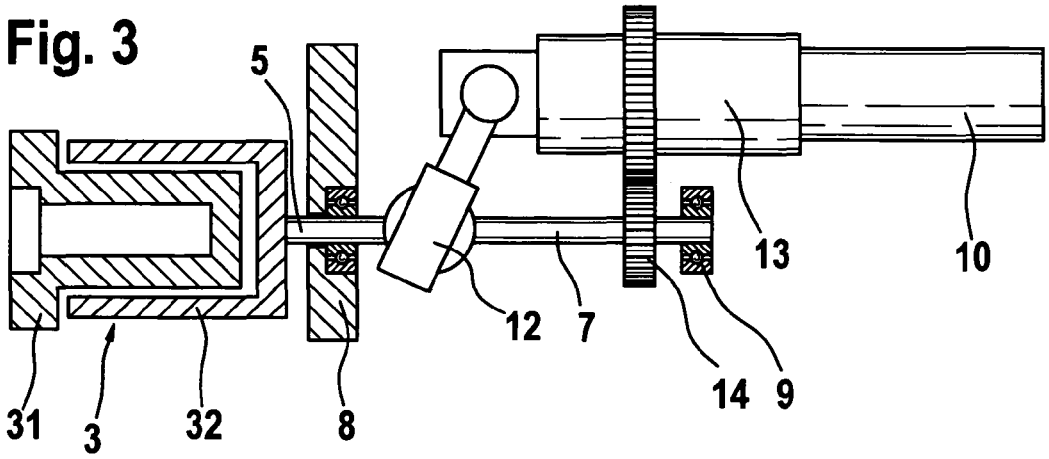
FIG. 3 is a basic illustration of a drill hammer/chisel hammer, in which the motor shaft of an external rotor is rotatably supported in a flange fixed in the housing.
Figure 4:
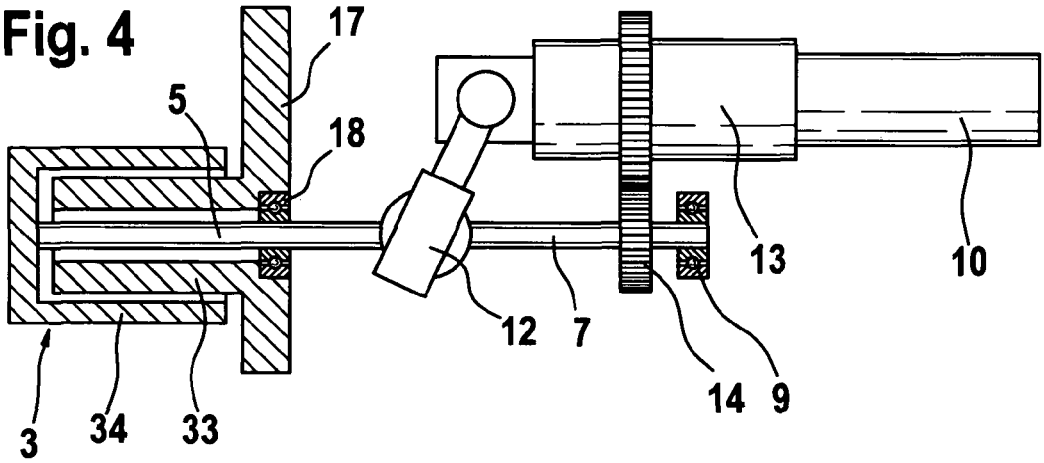
FIG. 4 is a basic illustration of a drill hammer/chisel hammer, in which the motor shaft of an external rotor is singly supported in the stator.
Figure 5:
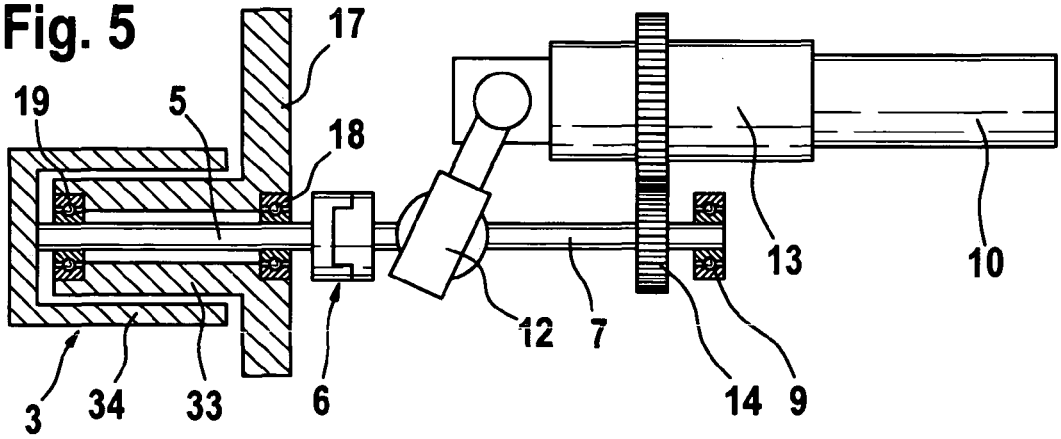
FIG. 5 is a basic illustration of a drill hammer/chisel hammer, in which the motor shaft of an external rotor motor is multiply rotatably supported in the stator.

The exemplary embodiments shown in FIGS. 3, 4 and 5 show different variants of the embodiment of the external rotor motor and of the bearing of the motor shaft. The illustrations in FIGS. 3, 4 and 5 are limited to a few functional structural groups of a drill hammer/chisel hammer.

In the version shown in FIG. 3, the motor shaft 5, connected to the rotor 32 of the external rotor motor 3, forms a unit with the intermediate shaft 7. That is, in this case the motor shaft 5 takes on the function of an intermediate shaft 7 directly. The external rotor motor 3 is constructed here similarly to that of the exemplary embodiment of FIG. 2; the rotor 32 that in cuplike fashion surrounds the stator 31 is oriented toward the intermediate shaft 7 with its cup bottom that is connected to the motor shaft 5. The motor shaft, as in the exemplary embodiments described above in conjunction with FIGS. 1 and 2, is supported in a flange 8 located near the motor 3 and affixed to the power tool housing 2. A second rotary bearing 9 is located on the end of the motor shaft 5 toward the tool receptacle.

FIG. 4 shows a version of the external rotor motor 3 in which the cup-shaped rotor 34 is oriented with its open end toward the intermediate shaft 7. The motor shaft 5 secured to the cup bottom of the rotor 34 is passed through the stator 33 and once again forms a unit with the intermediate shaft 7. The stator 33, on its end protruding out of the rotor 34 and oriented toward the intermediate shaft 7, has a bearing bridge 17, which is affixed to the power tool housing 2. A rotary bearing 18 for the motor shaft 5 is located in this bearing bridge 17.

The exemplary embodiment shown in FIG. 5 differs from the exemplary embodiment described above for FIG. 4 in that the motor shaft 5 is additionally supported inside the stator 33. That is, on the end of the stator 33 oriented toward the cup bottom of the rotor 34, there is a further rotary bearing 19 for the motor shaft 5. This additional rotary bearing 19 for the motor shaft 5 is expedient for secure radial support of the motor shaft 5 whenever a coupling 6 is located between the motor shaft 5 and the intermediate shaft 7.

The description of the concept of the invention has been made above in terms of a drill hammer/chisel hammer. The direct transition from a motor shaft to an intermediate shaft—without the interposition of a gear—may also be utilized in other handheld power tools that have a rotating and/or axially oscillating drive mechanism. This makes sense especially if an external rotor motor is used, which with its rotor located on the outside exerts relatively high torque, because then the high torque of the motor shaft can be transmitted directly to a drive shaft (intermediate shaft) of the power tool.

The invention claimed is:

1. A handheld power tool comprising a housing; a tool receptacle; a motor having a motor shaft; an intermediate shaft; means for transmitting a rotation of said motor shaft to a rotary motion of said intermediate shaft; a drive mechanism for a tool insertable into said tool receptacle, wherein said drive mechanism is provided with means for converting the rotary motion of said intermediate shaft into a rotary motion of said tool receptacle and means for converting the rotary motion of said intermediate shaft into a hammering motion of said tool receptacle, wherein said motor shaft is coaxial with said intermediate shaft, said motor shaft and said intermediate shaft having two opposite ends including a first end which is facing said motor and a second end which is facing said receptacle, said means for converting the rotary motion of said intermediate shaft into a rotary motion of said tool receptacle and said means for converting the rotary motion of said intermediate shaft into a hammering motion of said tool receptacle being located between said first and second ends on said motor shaft and said intermediate shaft.

2. A handheld power tool as defined in claim 1, wherein said motor shaft and said intermediate shaft are unitary with each other.

3. A handheld power tool as defined in claim 1, further comprising means for coupling said motor shaft to said intermediate shaft coaxially.

4. A handheld power tool as defined in claim 1, wherein said motor is an electronically commutated DC motor.

5. A handheld power tool as defined in claim 4, wherein said electronically commutated DC motor has an external rotor and a stator.

6. A handheld power tool as defined in claim 1, wherein said motor shaft is rotatably supported on its end facing away from said intermediate shaft in a stator of said motor.

7. A handheld power tool as defined in claim 1, wherein said means for converting the rotary motion of said intermediate shaft into the rotary motion of said tool receptacle is arranged closer to said second end, while said means for converting the rotary motion of said intermediate shaft into the hammering motion of said tool receptacle is located closer to said first end of said motor shaft and said intermediate shaft.

8. A handheld power tool as defined in claim 7, further comprising a first supporting element which supports said first end of said motor shaft and said intermediate shaft and a second supporting element which supports said second end of said motor shaft and said intermediate shaft, said means for converting the rotary motion of said intermediate shaft into the rotary motion of said receptacle and said means for converting said rotary motion of said intermediate shaft into the hammering motion of said tool receptacle are located between said supporting elements.

* * * * *